US005588159A

United States Patent [19]

Poulson et al.

[11] Patent Number: 5,588,159

[45] Date of Patent: Dec. 31, 1996

[54] INFANT BATHTUB WITH MULTIPLE-POSITION INFANT SUPPORT

[75] Inventors: Keith L. Poulson, Westminster; Robert M. Parker, Aurora; Jeffrey T. Samson, Boulder; Harry B. Taylor, Lafayette, all of Colo.

[73] Assignee: Gerry Baby Products Company, Thornton, Colo.

[21] Appl. No.: 559,167

[22] Filed: Nov. 13, 1995

[51] Int. Cl.[6] ..... A47K 3/024

[52] U.S. Cl. ..... 4/572.1; 4/573.1; 4/575.1; 4/621; 4/659; 4/523

[58] Field of Search ..... 4/571.1, 572.1, 4/573.1, 575.1, 578.1, 579, 539, 621, 659, 516, 517, 518, 520, 521, 522, 523

[56] References Cited

U.S. PATENT DOCUMENTS

| | | | |
|---|---|---|---|
| 987,646 | 3/1911 | Schmidt | 4/579 |
| 1,676,354 | 7/1928 | Sachsse | 4/575.1 |
| 2,985,889 | 5/1961 | Fain et al. | 4/185 |
| 3,086,222 | 4/1963 | Hall et al. | 4/185 |
| 4,037,591 | 7/1977 | Sarno | 4/573.1 |
| 4,266,306 | 5/1981 | Lee | 4/572 |
| 4,719,653 | 1/1988 | Bishop et al. | 4/572 |
| 4,974,267 | 12/1990 | Sheu | 4/572 |
| 5,276,926 | 1/1994 | Lopez | 4/568 |
| 5,297,300 | 3/1994 | Sheu | 4/572.1 |
| 5,425,149 | 6/1995 | Crossley et al. | 4/572.1 |

FOREIGN PATENT DOCUMENTS

| | | | |
|---|---|---|---|
| 240882 | 11/1911 | Germany | 4/573.1 |
| 3103424 | 9/1982 | Germany | 4/578.1 |
| 2053673 | 2/1981 | United Kingdom | 4/571.1 |

*Primary Examiner*—Henry J. Recla
*Assistant Examiner*—Charles R. Eloshway
*Attorney, Agent, or Firm*—Biebel & French

[57] ABSTRACT

Combination bathtub and infant-supporting insert are provided with interengagable members for firmly holding the insert in any of multiple inclined positions, enabling support of an infant on its back from a near horizontal position shortly after birth to a near-upright position at the stage that it is almost ready to outgrow the tub. The tub and insert are each preferably injection molded as a single piece from an appropriate plastic material. The infant-supporting surface is smoothly contoured to properly support the back, head and bottom of the infant in all angles of inclination, regardless of the infant's size.

10 Claims, 5 Drawing Sheets

INFANT BATHTUB WITH MULTIPLE-POSITION INFANT SUPPORT

This invention relates generally to a tub for bathing an infant, and particularly to such a tub which includes an infant-supporting insert which may be arranged at different angles to suit the manner in which the person bathing the infant wishes to have the infant lie during bathing.

BACKGROUND OF THE INVENTION

Bathtub inserts for enabling either an infant (and in some cases a handicapped adult) to be positioned in the tub at various angles are known. Where there is adjustability of the angle of inclination of the support, however, the support normally includes movable parts such as legs which fold beneath the support or can be adjustably raised and lowered for different angles of the support itself. Whenever auxiliary pans are provided, and particularly where they are immersed in the bath water during bathing, a problem of contamination from soap residues and dirt exists. The possibility of corrosion of the parts or hinges for the pans exists in those instances where the movable parts may be made of a metal which is subject to corrosion. Examples of U.S. patents falling in the category described above are U.S. Pat. Nos. 5,297,300; 5,276,926; 4,266,306; and 4,974,267. It is also known to provide an infant bathtub which is capable of being used either with or without a detachable infant-supporting insert. When used with the insert in place, the insert is snapped into position at a given angle of inclination, but is limited to use at only that single angle.

SUMMARY OF THE INVENTION

The invention relates to a combination bathtub and infant-supporting insert which are provided with interengagable means for firmly holding the insert in any of multiple inclined positions, enabling continued use of the same unit from birth until the infant outgrows the tub. The tub and the insert are each preferably injection molded as a single piece from polypropylene or some other appropriate plastic material, and are void of any movable parts. The infant-supporting surface is smoothly contoured to properly support the back, head and bottom (buttocks) of the infant in all angles of inclination, regardless of the infant's size.

The principal object of the invention is to provide an insert for an infant bathtub, which insert is capable of supporting the back, head and bottom of an infant in any of several different angles of inclination.

A further object is to provide such an insert with means on its underside that is engagable with cooperating means on the upper side of the tub adjacent its top edge so as to enable the insert, when positioned in any one of its angles of inclination, to be firmly maintained in that position while the parts are interengaged.

Another object is to provide a two-piece infant tub and multi-position insert having easily cleanable surfaces which are void of operating parts for obtaining the various positions.

Other objects and advantages will be apparent from the following description in which reference is made to the accompanying drawings.

DESCRIPTION OF THE PREFERRED EMBODIMENT

Figure 1:
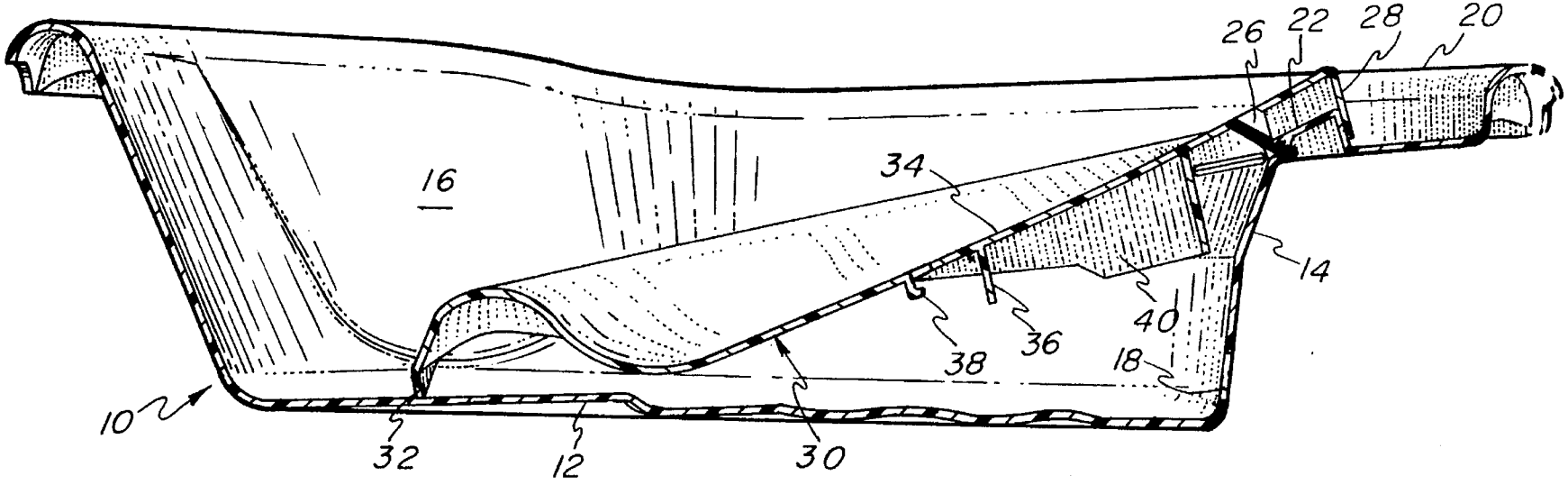
FIG. 1 is a cross-sectional elevational view of a tub and insert for supporting an infant at an angle of approximately 20 to 30 degrees from horizontal.

FIG. 1 illustrates in cross section an infant-tub 10 having a bottom wall 12, a head end wall 14 and a remaining wall 16 encompassing the rest of the tub 10 from one side of the head end wall 14 to the other, and enclosing the tub 10 to provide for retention of water therein during bathing of the infant. The head end wall 14 may have a drain opening 18 therein, which drain opening is typically covered by a drain plug (not shown) when the tub contains water. A curved rim 20 extends fully around the outer periphery at the top edges of the tub 10. The tub 10 is preferably injection molded of polypropylene or another suitable plastic in one piece.

At the upper edge of the head end wall 14, there is provided a ridge 22 which extends laterally of the tub 10 at the wall 14 and extends upwardly to provide an acute angle peak for purposes to be described. This ridge 22 may be seen in greater detail in FIG. 3. Adjacent the lower end of the ridge 22 is a notch 24 which is positioned approximately on the center line (not shown) of the tub 10. A laterally-extending depending wall 28 at the head end of an infant-supporting insert 30 is positioned to engage the rightward side of the ridge 22 when the insert 30 is inclined as shown in FIG. 1. A first hook member 26 extends downwardly from the underside of the insert 30 and is positioned in relation to the depending wall 28 so that whenever the wall 28 is in contact with the rightward side of the ridge 22, a hook portion of the hook member 26 will engage in the notch 24. With the hook member 26 and wall 28 in this position, the insert 30 is maintained firmly against movement relative to the tub 10. At such time, a foot end 32 of the insert 30 rests against the bottom wall 12, and the angle of inclination of a main supporting surface 34 of the insert 30 for receiving the back and head of the infant lies in an incline position approximately 20 to 30 degrees relative to the bottom wall 12. The surface 34 is contoured to receive the bottom end of the infant in the position shown and has a reverse curve to support its legs or at least the underside of the infant's thighs. Like the tub 10, the insert 30 is preferably molded from polypropylene as a single piece.

Figures 2, 3:
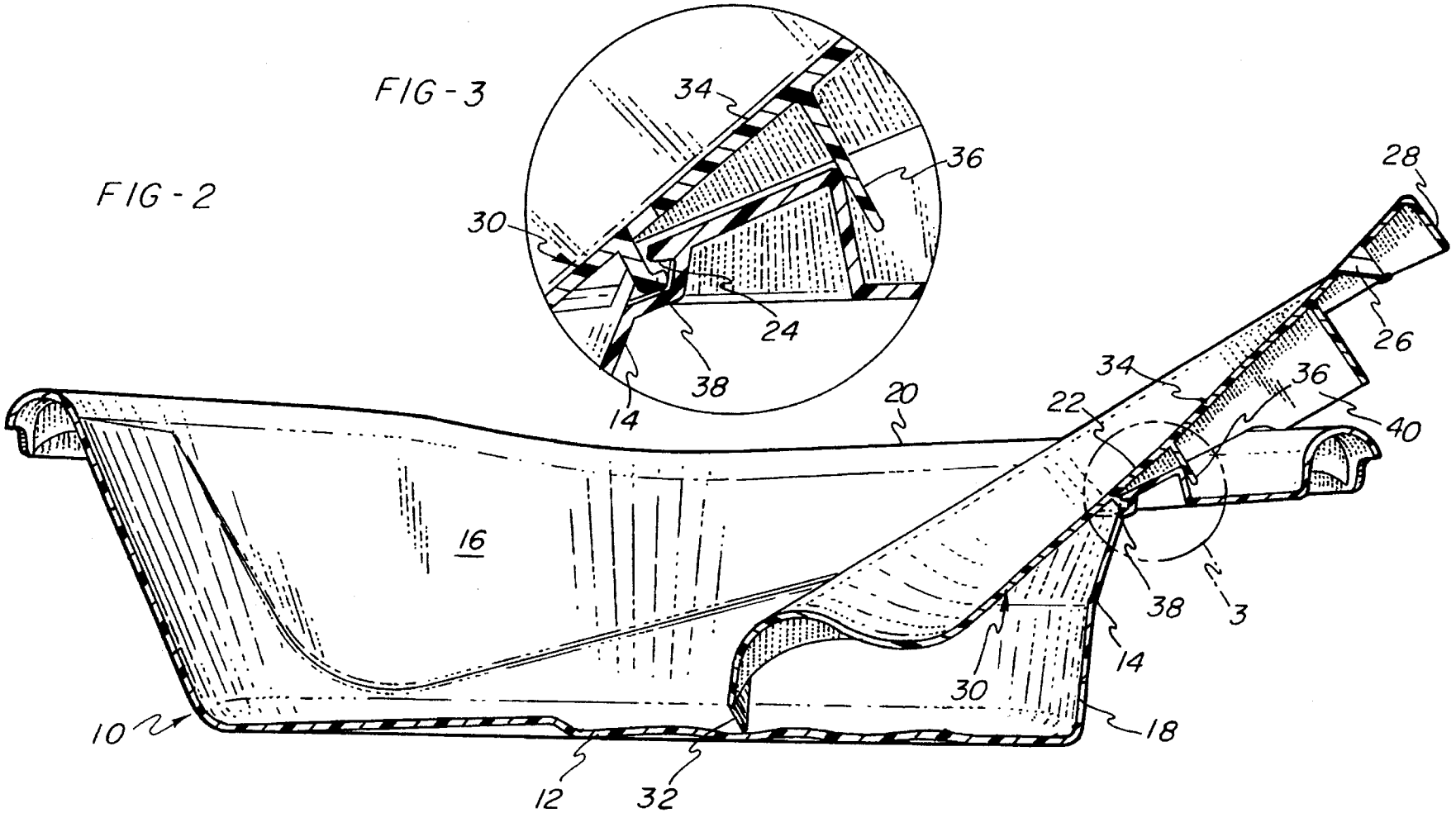
FIG. 2 is a view similar to FIG. 1 with the insert being positioned in relation to the tub at approximately 35 to 45 degrees relative to the bottom of the tub.
FIG. 3 is a fragmentary enlarged view of the interengagable means of the preferred form of the invention as illustrated within the circle 3 of FIG. 2.

FIG. 2 illustrates a second position of the infant-supporting insert 30 in which the infant may be inclined at approximately 35 to 45 degrees relative to the bottom wall 12. A depending plate portion 36 and a second hook member 38 arranged similarly to the depending wall 28 and first hook member 26 are intended to cooperate with the ridge 22 and maintain the insert 30 at the inclination angle of about 35 to 45 degrees, as shown in FIG. 2. It will thus be seen that the first hook member 26 and the second hook member 38 cooperate with the notch 24 in essentially identical fashion but in order to accomplish this, the hooking edges of first member 26 and second member 38 are at different angles due to different angles of inclination of the insert 30. For example, the hooking edge of member 26 is nearly parallel to the adjacent surface of this insert, while the hooking edge of member 38 may be 30 degrees relative to insert 30. The depending wall 28 and the depending plate portion 36 cooperate with one side of the ridge 22 in essentially the same fashion. However, in FIG. 1 the wall 28 contacts the side of the ridge 22, while in FIG. 2, the plate portion 36 contacts only the peak. While there has been illustrated a particular kind of hook and latching system, it is to be understood that many different kinds of interengagable means may be employed to accomplish the objectives described herein. It is important however that whatever interengagable means is employed, it be such that the retention of the insert 30 be maintained so as to avoid any possible disconnection of the insert 30 from the tub 10 while an infant is being washed.

Figure 4:
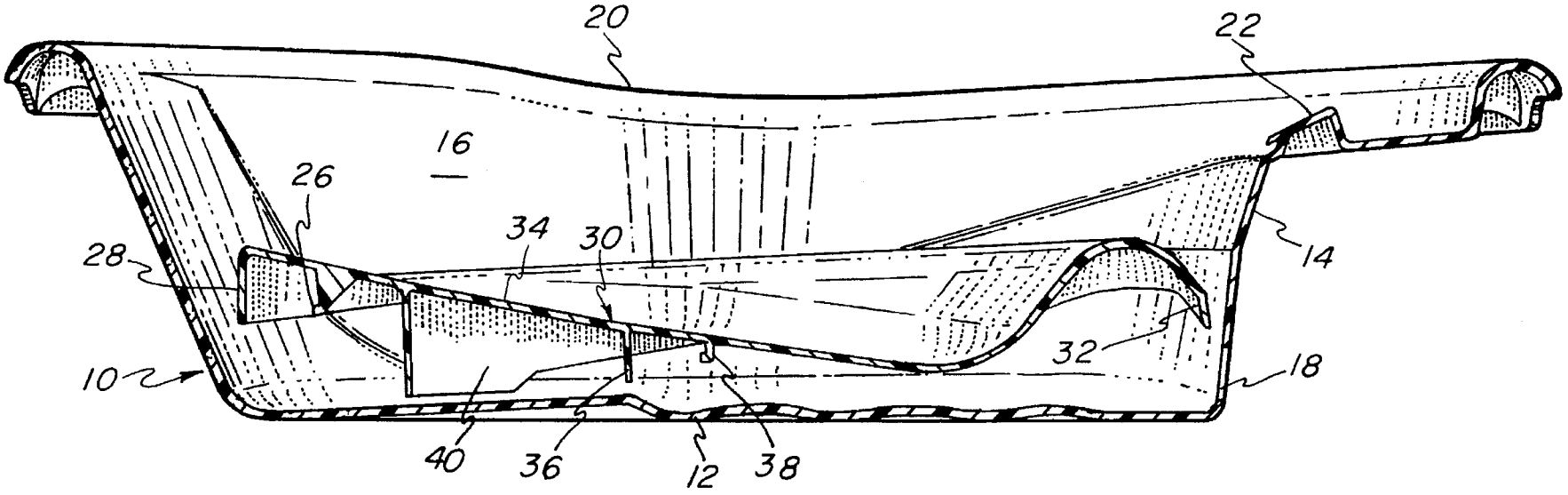
FIG. 4 is a view similar to FIGS. 1 and 2, but with the insert lying on the bottom of the tub either for supporting the infant at approximately 5 to 15 degrees relative to horizontal or for storing the insert in the tub when not in use.

In some instances, particularly in those where the infant is a newborn, neither of the inclined positions of FIGS. 1 and 2 may be desired by its mother. Under such circumstances, the insert 30 may be placed on the bottom wall 12 of the tub 10 as shown in FIG. 4, filling only the very bottom of the tub 10 with water. In FIG. 4, the infant would lie with its head only slightly above its bottom side, approximately at an angle of 5 to 15 degrees relative to the bottom wall 12. In order to support the insert 20 properly in this position, a leg 40 (shown best in the underside view of the insert in FIG. 6) can be used to support the head end of the insert. The inner contour of the tub is such that the depending wall 28 and foot end 32 of the insert 30 make contact with the inner side surfaces of the tub 10 when the leg 40 rests on the bottom wall 12 of the tub 10. The FIG. 4 position may also be used for storing the tub and insert while not in use. The insert 30 may also be used independently such as on a counter top or diaper changing table. In such an instance, the position of the insert 30 is essentially like that shown in FIG. 4, but with the leg 40 and seat portion of the insert 30 essentially positioning the insert 30 generally slightly off the horizontal.

Figure 5:
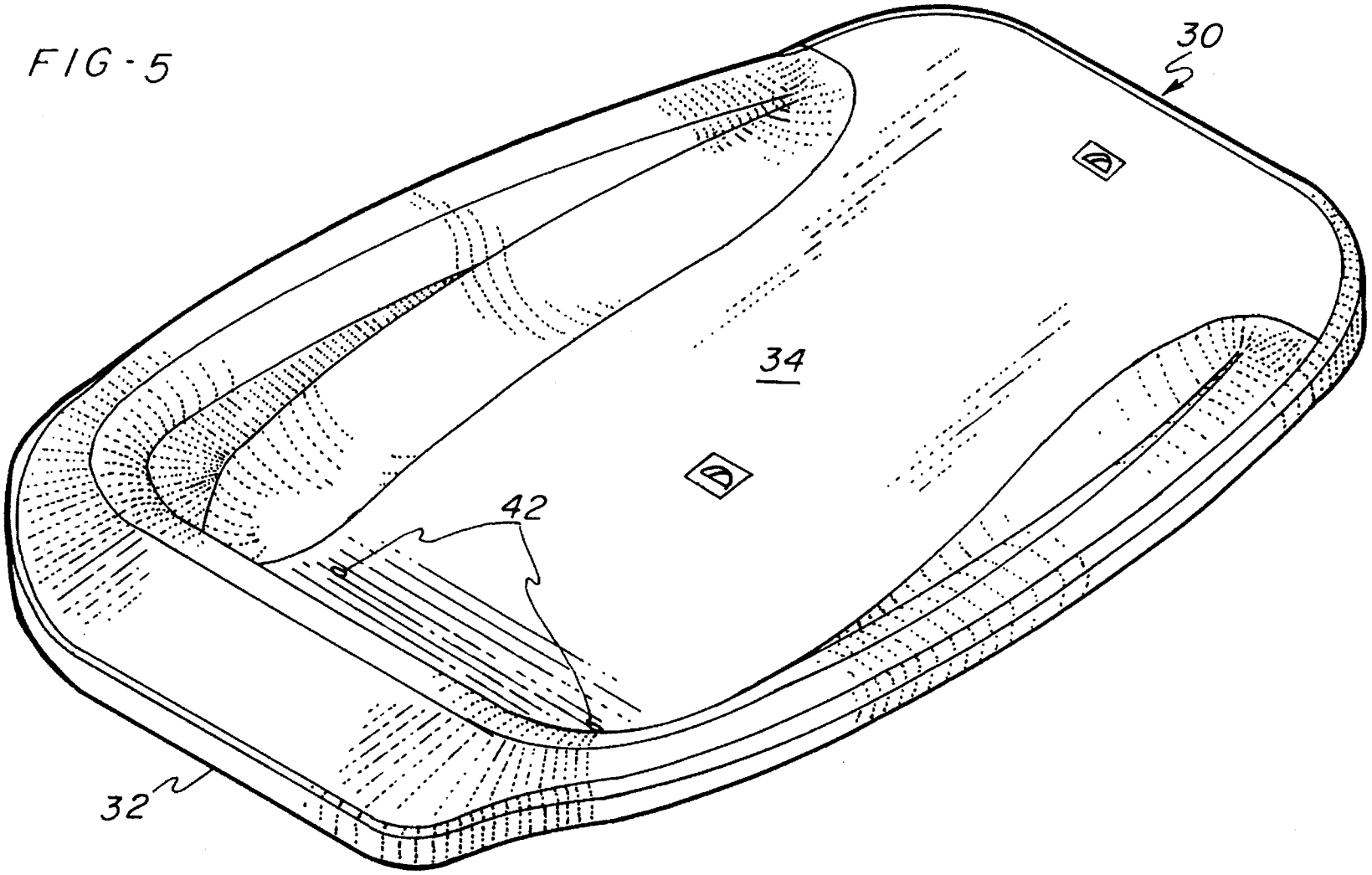
FIGS. 5 and 6 are isometric views of the insert from the top side and bottom side respectively.
Figure 6:
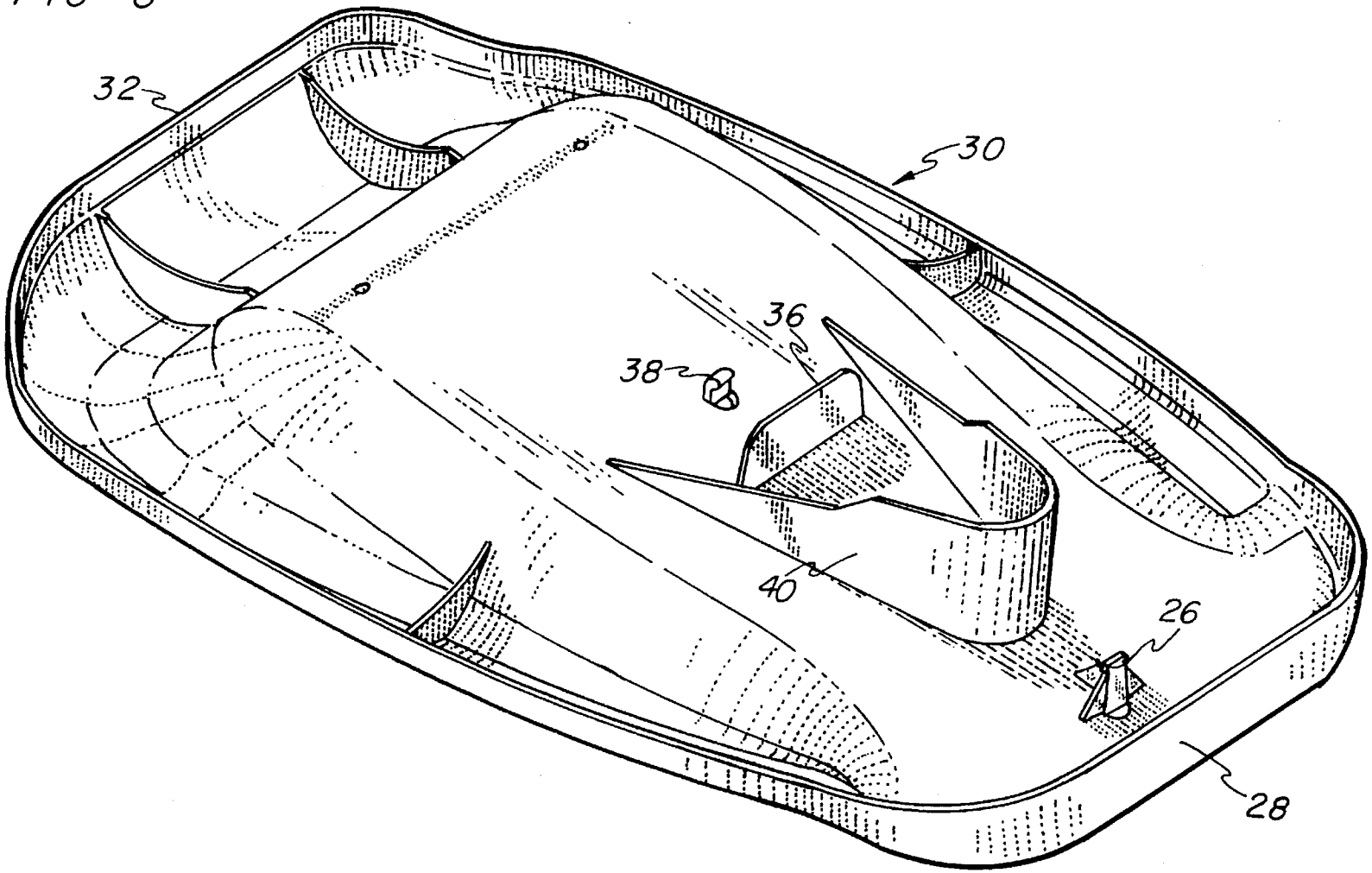

FIGS. 5 and 6 show the top and bottom sides respectively of the insert 30. It can be seen that the top side is contoured to comfortably fit the back, bottom, legs and head of an infant. Drain holes 42 may be located in the lowermost position where the infant's bottom engages the upper surface of the insert 30.

Various changes may be made without departing from the spirit and scope of the claims.

Having described our invention, we claim:

1. In an infant bathtub for comfortably supporting the head, back and bottom of an infant in any one of multiple inclined positions, comprising:

a tub having a generally horizontal bottom wall, a head end wall portion extending upwardly from said bottom wall and having an upper inside surface, and a generally vertical wall extending upwardly from and encompassing the remainder of said bottom wall for retaining bath water between said bottom wall and the upwardly extending walls;

a removable, elongated infant-supporting insert having an upper surface contoured to comfortably support the bottom, back and head of an infant, and an underside surface opposite said upper surface; and, interengagable means on the underside surface of said insert and integrally formed on the upper inside surface of said head end wall for firmly supporting and maintaining said insert in at least two different angles of inclination in said tub, said interengagable means including;

i. a first gripping portion at the upper inside surface of said head end wall; and, ii. a pair of second gripping portions on the underside of said insert, said pair of second gripping portions being spaced longitudinally along said insert and each one of said pair being independently engageable with said first gripping portion whereby only one of said pair of second gripping portions is active to support and maintain said insert in cooperation with said first gripping portion in a given one of said different angles of insert inclination.

2. An infant bathtub according to claim 1 wherein the first gripping portion of said interengagable means includes an upstanding ridge adjacent an upper end of the upper inside surface of said head end wall and wherein each second gripping portion includes a member depending from the underside surface of said insert and extending laterally thereof, said depending member engaging and hooking with that side of the ridge facing away from said tub when a lowermost end of said insert is in contact with the bottom wall of said tub.

3. An infant bathtub according to claim 1 wherein one of said first and second gripping portions of said interengagable means includes a notch and the other of said first and second gripping portions includes a hook member insertable in and retractable from said notch.

4. An infant bathtub according to claim 3 wherein said notch is located on the upper inside surface of said tub and said second gripping portions comprise a like pair of said hook members extending downwardly from the underside of said insert.

5. An infant bathtub according to claim 4 wherein said notch is located closely adjacent said ridge on that side thereof facing toward the bottom wall of said tub.

6. An infant bathtub according to claim 1 wherein there is further included a leg depending from the underside of said insert, and wherein said leg and an end of the insert cooperate to support said insert in a third inclined position on said bottom wall at an angle on the order of 5 to 15 degrees relative to said bottom wall.

7. An infant bathtub according to claim 6 wherein said leg lies approximately midway between said pair of second gripping portions.

8. An infant bathtub according to claim 1 wherein at least one inclined position is on the order of 20 degrees to 30 degrees relative to horizontal, and another of said inclined portions is on the order of 35 degrees to 45 degrees relative to horizontal.

9. An infant bathtub according to claim 8 wherein said underside of said insert includes a leg depending from said underside, and wherein said leg and an end of the insert support said insert in a third inclined position on said bottom wall at an angle on the order of 5 degrees to 15 degrees relative to said bottom wall.

10. An infant bathtub according to claim 8 wherein said first gripping portion includes a hook-engaging edge notch in said tub, said first and second gripping portions comprising first and second hook members each having a notch-engaging edge for latching contact with said hook-engaging edge of said notch, the notch-engaging edges of said first and second hook members being at different angles with respect to said insert as to obtain edge contact between said notch and the hook members at respective different angles of said insert relative to said tub.

* * * * *